United States Patent [19]

Powers et al.

[11] Patent Number: 5,061,944

[45] Date of Patent: Oct. 29, 1991

[54] BROAD-BAND HIGH-DIRECTIVITY ANTENNA

[75] Inventors: Richard L. Powers, Nashua, N.H.; Russell J. Cyr, Pepperell, Mass.

[73] Assignee: Lockheed Sanders, Inc., Nashua, N.H.

[21] Appl. No.: 401,889

[22] Filed: Sep. 1, 1989

[51] Int. Cl.[5] ..... H01Q 19/185

[52] U.S. Cl. ..... 343/795; 343/818; 343/819; 343/821

[58] Field of Search ..... 343/792, 795, 807, 812, 343/818–822, 833, 834

[56] References Cited

U.S. PATENT DOCUMENTS

| | | | |
|---|---|---|---|
| Re. 24,413 | 1/1958 | Weiss | 343/815 |
| 2,530,048 | 11/1950 | Driscoll | 343/821 |
| 2,580,798 | 1/1952 | Kolster | 343/795 |
| 2,821,711 | 1/1958 | Lo | 343/819 |
| 3,096,520 | 7/1963 | Ehrenspeck | 343/819 |
| 3,845,490 | 10/1974 | Manwarren et al. | 343/821 |
| 4,604,628 | 8/1986 | Cox | 343/792 |

FOREIGN PATENT DOCUMENTS 1809377 6/1970 Fed. Rep. of Germany ..... 343/819

OTHER PUBLICATIONS

*Proceedings of the IEEE*, vol. 59, No. 12, Dec. 1971 entitled, "Optimization Techniques for Antenna Arrays", by Cheng.

*IEEE Transactions on Antennas and Propagation*, vol. AP-21, No. 5, Sep. 1973, "Optimum Element Spacings for Yagi-Uda Arrays", by Cheng and Chen.

*IEEE Transactions on Antennas and Propagation*, vol. AP-23, No. 1, Jan. 1975, "Optimum Element Lengths for Yagi-Uda Arrays", by Cheng and Chen.

*Primary Examiner*—Michael C. Wimer

*Attorney, Agent, or Firm*—Robert G. Crooks

[57] ABSTRACT

This Yagi-Uda-type antenna includes also a sleeve embracing the dipole. The sleeve may be a closed cylindrical element surrounding the dipole or it may comprise a pair of discrete elements forming an "open sleeve". The dipole, sleeve, reflector, and director elements may be in filamentary form, or they may be fabricated from stripline.

20 Claims, 4 Drawing Sheets

SIDE VIEW

SECTIONAL VIEW

BROAD-BAND HIGH-DIRECTIVITY ANTENNA

This invention relates to an antenna having high directivity or "gain" throughout a considerable band of frequencies of electromagnetic energy. The antenna is well adapted for either transmission or reception of energy in the low range of microwave frequencies or in the ultra-high-frequency band.

BACKGROUND OF THE INVENTION

The so-called "Yagi-Uda antenna" has been successfully used for many years in applications such as reception of television signals, point-to-point communications, and certain types of military electronics. The Yagi-Uda antenna can be designed to have high directivity or gain and low voltage-standing-wave ratio ("VSWR") throughout a narrow band of contiguous frequencies. It is also possible to operate the Yagi-Uda antenna in more than one band of frequencies provided that each band is relatively narrow and provided further that the mean frequency of one band is an odd multiple of the mean frequency of another band.

In the Yagi-Uda antenna, there is a single element which is driven from the source of electromagnetic energy. That element is commonly a half-wave dipole. Arrayed with the dipole element are certain parasitic elements, typically a so-called "reflector" element on one side of the dipole, and a plurality of so-called "director" elements on the other side of the dipole. The director elements are usually disposed in spaced relationship in the portion of the antenna pointing in the direction to which electromagnetic energy is to be transmitted, or from which signal energy is to be received in the case of a receiving antenna. The reflector element, on the other hand, is disposed on the side of the dipole opposite from the array of director elements.

During the period of time since the introduction of commercial television, a great deal of effort has been exerted to design Yagi-Uda antennas having optimum directivity at a single frequency or near-optimum directivity over some specified bandwidth of frequencies. The approach to such optimization was explained in a paper by Dr. David K. Cheng, published in the *Proceedings of the Institute of Electrical and Electronics Engineers,* Volume 59 No. 12, December 1971, entitled "Optimization Techniques for Antenna Arrays." Further material directed to the optimization of Yagi-Uda antennas was published by Dr. Cheng together with C. A. Chen in the *Transactions of the Institute of Electrical and Electronics Engineers on Antennas and Propagation,* Volume AP-21, No. 5, September 1973 and Volume AP-23, No. 1, January 1975. One of the papers by Cheng and Chen related to the optimization of the spacing of the parasitic elements in Yagi-Uda antennas. The other paper related to optimization of the lengths of the parasitic elements in such antennas. By using so-called "perturbation techniques", Cheng and Chen were able to adjust the inter-element spacings and the lengths of the elements to obtain relatively high directivity over a narrow band of frequencies. In this way, Cheng and Chen achieved a directivity of 9.9 dB±2.1 dB over a twenty-nine-percent bandwidth, but the voltage-standing-wave ratio achieved by Cheng and Chen in this way maintained a value less than 3.0 to 1 over only a nineteen-percent bandwidth.

In U.S. Pat. No. 2,688,083, Elmer G. Hills disclosed a way of configuring a Yagi-Uda antenna to achieve coverage of two relatively narrow frequency bands which were non-contiguous with each other. In 1950, when Mr. Hills filed the application on which the aforementioned patent was granted, there were only two frequency bands authorized for commercial television in the United States. The lower frequency band extended from 54 megahertz to 88 megahertz, while the higher frequency band covered the range between 174 megahertz and 216 megahertz. Taking advantage of the fact that the mean frequencies in those respective bands were related to each other roughly in the ratio of 1 to 3, Mr. Hills ingeniously devised a way to cover both bands with a single antenna. However, the frequencies between the two bands were almost entirely outside the receiving capability of the antenna disclosed and claimed in his patent. He did not achieve high directivity over a relatively wide band of contiguous frequencies.

OBJECTS OF THE INVENTION

In view of the deficiencies of the prior art in achieving satisfactory directivity throughout a substantial bandwidth of contiguous frequencies, it is an object of our invention to provide a new and improved antenna for use at ultra-high frequencies and microwave frequencies and which is characterized by high directivity over a relatively wide band of contiguous frequencies.

It is another object of our invention to provide a new and improved broad-band high-gain antenna in which the voltage-standing-wave ratio over the entire operating frequency range of the antenna is maintained below a certain value, such as 3.0 to 1.

It is a further object of our invention to achieve a useful operating range of at least thirty-three percent without "low points" of gain anywhere in the operating range of the antenna.

It is a still further object of our invention to provide an antenna which is compact in size and inexpensive to manufacture for satisfactory employment throughout commercially significant frequency ranges.

It is a more specific object of our invention to provide an antenna giving continuous coverage, with high directivity or gain, between 1500 megahertz and 2000 megahertz.

SUMMARY OF THE INVENTION

Briefly, we have fulfilled the above-mentioned and other objects of our invention by providing a modified Yagi-Uda antenna in which the dipole element, which is fed from a source of electromagnetic energy of suitable frequency, is arrayed with certain parasitic element or elements besides the aforementioned reflector and directors that are included in most Yagi-Uda antennas. Specifically, the additional element may take the form of a full or partial cylinder which partly envelops the dipole element. Such a cylinder is sometimes called a "sleeve". Alternatively, the additional parasitic elements may take the form of a pair of conductors positioned parallel to the dipole element and located in a plane passing through the dipole element and oriented substantially perpendicular to the axis of the antenna and to the direction in which energy passes through the antenna. These additional elements may be regarded as generatrices of the cylinder of the aforementioned sleeve. On the other hand, the additional elements may be electrically conductive sheets or coatings supported by dielectric material between themselves and the dipole element and having an appreciable dimension in a direction parallel to the passage of energy through the antenna. Such a configuration can be achieved, for example, by printing metallic coatings on plastic stripline which maintains the separation between the metallic coatings and the driven dipole element.

Just as we provide for the metallic coatings associated with the dipole element to be distributed in plural dimensions, we have found that it is also feasible to construct the reflector and director elements so that they are also distributed in plural dimensions, with a substantial breadth in the direction of passage of energy through the antenna. Once again, stripline techniques may be used for supporting printed reflector and director elements, as well as the metallic coatings associated with the dipole element. Parasitic elements not comprising a full cylindrical structure about the dipole are sometimes called "open sleeves".

Whether one chooses to surround the dipole element with a conductive cylinder or to position it between two conductive elements in the same plane as the dipole, perpendicular to the direction of passage of energy through the antenna, the electromagnetic effect is similar. Furthermore, whether one chooses to provide an open sleeve comprising substantially filamentary elements or instead to distribute the conductive material of those elements so as to have an appreciable dimension parallel to the direction of passage of energy through the antenna, once again the same objectives can be fulfilled. Those objectives are the maintenance of satisfactory directivity or gain throughout a relatively broad band of contiguous frequencies and simultaneously maintaining the voltage-standing-wave ratio below a certain tolerable level throughout that band of frequencies. We have also been able to achieve an acceptable match between the impedance of the antenna and the impedance of the transmission line from the energy source. We prefer to accomplish such impedance matching by the use of a so-called "balun" in the transmission line adjacent the dipole element in the direction of the source of energy. In particular, we favor a balun of the "quarter-wave-length type". However, it would be possible to employ a balun of either the "transformer type" or the "omega-match type".

BRIEF DESCRIPTION OF THE DRAWINGS

The invention summarized above will be described in detail in the following specification. The specification will be best understood if read while referring to the accompanying drawings, in which.

DESCRIPTION OF PREFERRED EMBODIMENTS

Figure 1:
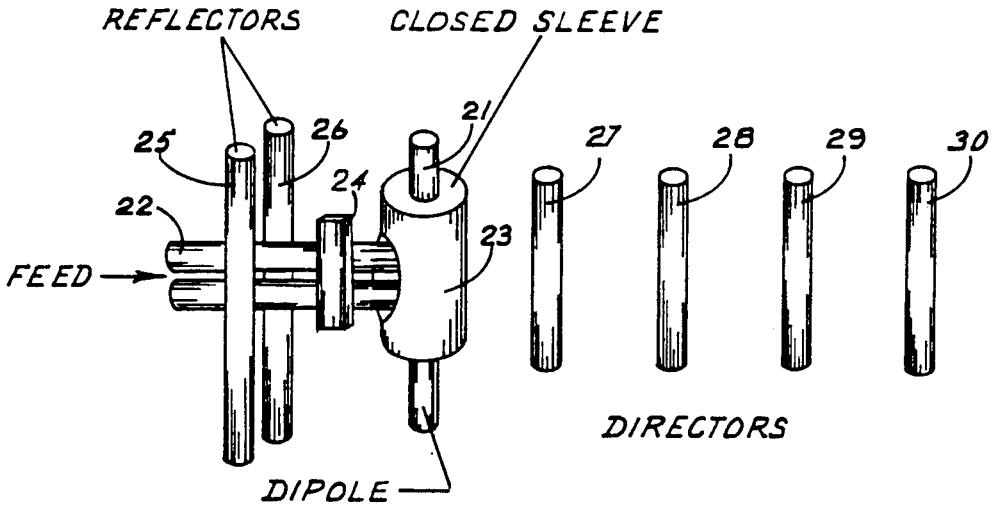
FIG. 1 is a schematic representation of an antenna in accordance with our invention in which the parasitic element embracing the dipole element is a "closed sleeve"

Turning to the schematic representation of FIG. 1 of the drawings, a dipole element 21 is supplied with electromagnetic energy by a source (not shown in the drawings) through a transmission line 22. Dipole element 21 should, of course, be an electrically conductive member and should be approximately one-half wavelength long at the geometric mean frequency of the band in which the antenna is to operate. Although shown schematically as a pair of conductors, transmission line 22 may be a coaxial cable in physical reality. A conductive cylindrical sleeve 23 surrounds dipole element 21 throughout a portion of the length of the dipole element. Sleeve 23 is in the nature of a parasitic element in that it is not connected conductively to dipole element 21 or to transmission line 22 but rather re-radiates energy which comes to it by radiation from transmission line 22 and dipole element 21. Dipole element 21, transmission line 22, and sleeve 23 may all be mounted on a sheet of dielectric material which gives mechanical support to the electrically conductive members without participating in the electromechanical functioning of the antenna. The dielectric material may be fiberglass-reinforced plastic, and is not shown in the schematic representation of FIG. 1.

The impedance of transmission line 22 may be matched to the impedance of dipole element 21, sleeve 23, and the other components of the antenna by means of an impedance-matching device such as the balun 24 shown schematically in FIG. 1. If transmission line 22 is coaxial, balun 24 may be connected between the outer conductor of transmission line 22 and the side of dipole element 21 connected to the inner conductor of transmission line 22. Balun 24 may be coupled to the outer conductor of transmission line 22 approximately one-quarter wavelength from dipole element 21. In place of the just-described "quarter-wave balun", it would be possible to substitute either a "transformer-type" or "omega-match type" balun or other suitable impedance-matching device. Recognizing that the type of balun is a matter of choice, balun 24 is represented as a "block" in FIG. 1, and balun 50 is represented as a "block" in FIG. 2.

As mentioned in the introduction to this specification, a Yagu-Uda antenna includes a reflector element positioned in the antenna array at some distance from the dipole element in a direction away from the direction in which energy is transmitted or from which it is received by the antenna. We 1 have chosen to employ a pair of reflector elements 25 and 26 which "straddle" transmission line 22. Reflector elements 25 and 26 can be supported by the same sheet of dielectric material that supports dipole element 21 and sleeve 23. We prefer to use a pair of reflector elements 25 and 26 rather than a single reflector in order to achieve symmetry about transmission line 22, which could not be done with a single reflector element. It will be understood that the orientation of dipole element 21, sleeve 23, and reflectors 25 and 26 is such that they are all parallel to the "E Vector" of the electromagnetic energy being transmitted or received by the antenna.

The lengths of reflector elements 25 and 26 should be equal, and they should be somewhat longer than dipole element 21. Specific lengths of typical reflector elements will be given in the discussion of FIG. 2 of the drawings. In that configuration, the closed sleeve has been replaced by an open structure. Detailed numerical dimensions will be given only for the configuration of FIG. 2.

Arrayed in spaced relationship with dipole element 21 and disposed in the direction toward which energy is to be transmitted or from which energy is to be received by the antenna are director elements 27, 28, 29, and 30 respectively. Director elements 27–30 are parasitic in that they are not connected conductively to dipole element 21 or to the source of energy. Furthermore, directors 27–30, like reflectors 25 and 26, may be supported on the sheet of dielectric material which orients them parallel to the E Vector of the electromagnetic energy. Inasmuch as the spacings between director elements 27–30 are preferably not uniform, optimized spacings will be given in connection with the discussion of the embodiment of FIG. 2.

Figure 2:
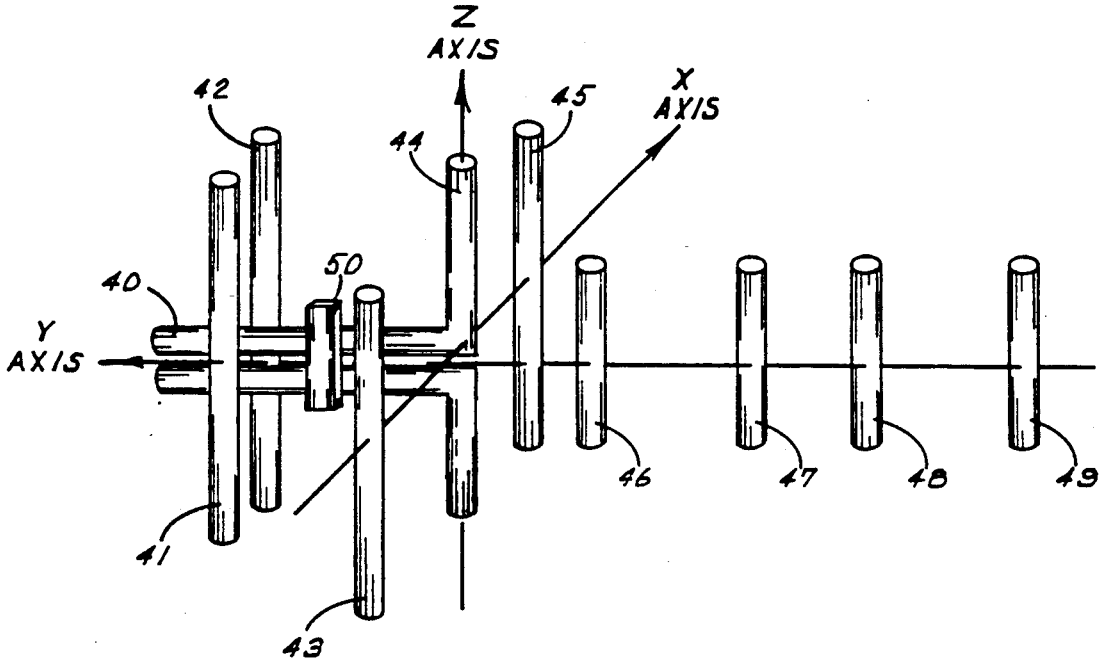
FIG. 2 is a schematic representation of an antenna in accordance with our invention in which the parasitic elements associated with the dipole element take the form of generatrices of a cylinder, those parasitic elements being positioned in a plane passing through the dipole element perpendicular to the direction of passage of energy through the antenna.

In the schematic representation of FIG. 2, the cylindrical sleeve 23 which appeared in FIG. 1 has been replaced by a pair of conductive elements, one on each side of the dipole element and positioned in the plane of the dipole element perpendicular to the direction of passage of electromagnetic energy through the antenna. If the just-mentioned conductive elements are idealized as "filamentary", they may be regarded as generatrices of a cylinder surrounding the dipole element and having the dipole element as its axis.

Although the aforementioned substitution of a pair of conductive elements for the cylindrical sleeve is the most apparent change in going from FIG. 1 to FIG. 2, there are other changes in proportions, spacings, and dimensions as well. Therefore, the reflector elements and director elements that appear in FIG. 2 are not identical to the corresponding reflectors and directors in FIG. 1. Accordingly, a new set of reference numerals will be assigned to the elements of FIG. 2. For convenience, the numerals will be assigned in such a way that they read in a natural fashion from left to right.

In FIG. 2, a transmission line 40, represented by a parallel pair, leads from a source of electromagnetic energy (not shown) at its left end, and is connected to a dipole element 44 at its right end. A pair of reflector elements 41 and 42 straddle transmission line 40 on the side of dipole element 44 toward the source of energy. Conductive elements 43 and 45 are disposed equidistant from dipole element 44 on opposite sides thereof.

For the sake of specificity of the dimensions and placement of elements of the antenna, a straight line drawn through dipole element 44 and through conductive elements 43 and 45 will be designated as the "X-axis". Likewise, a line drawn through dipole element 44 and extending through transmission line 40 along its axis or center line will be designated as the "Y-axis". The "origin" for measurement along both the X-axis and the Y-axis will be taken as the intersection of those axes with the center point of dipole element 44, which may actually be in space midway between the two arms of the dipole, each substantially one-quarter wavelength long at the mean frequency for which the dipole is designed. Positive directions along the X and Y axes are as indicated by the arrows in FIG. 2.

The axis of the "arms" of dipole element 44 is taken as the "Z-axis" for measurement purposes. Once again, an arrow in FIG. 2 indicates the positive direction along the Z-axis.

Disposed in space relationship along the negative portion of the Y-axis are director elements 46, 47, 48 and 49 respectively. An impedance-matching device such as a balun 50 is shown across transmission line 40 or connecting one arm of dipole element 44 to a point on transmission line 40 about one-quarter wavelength from dipole element 44.

Figure 3:
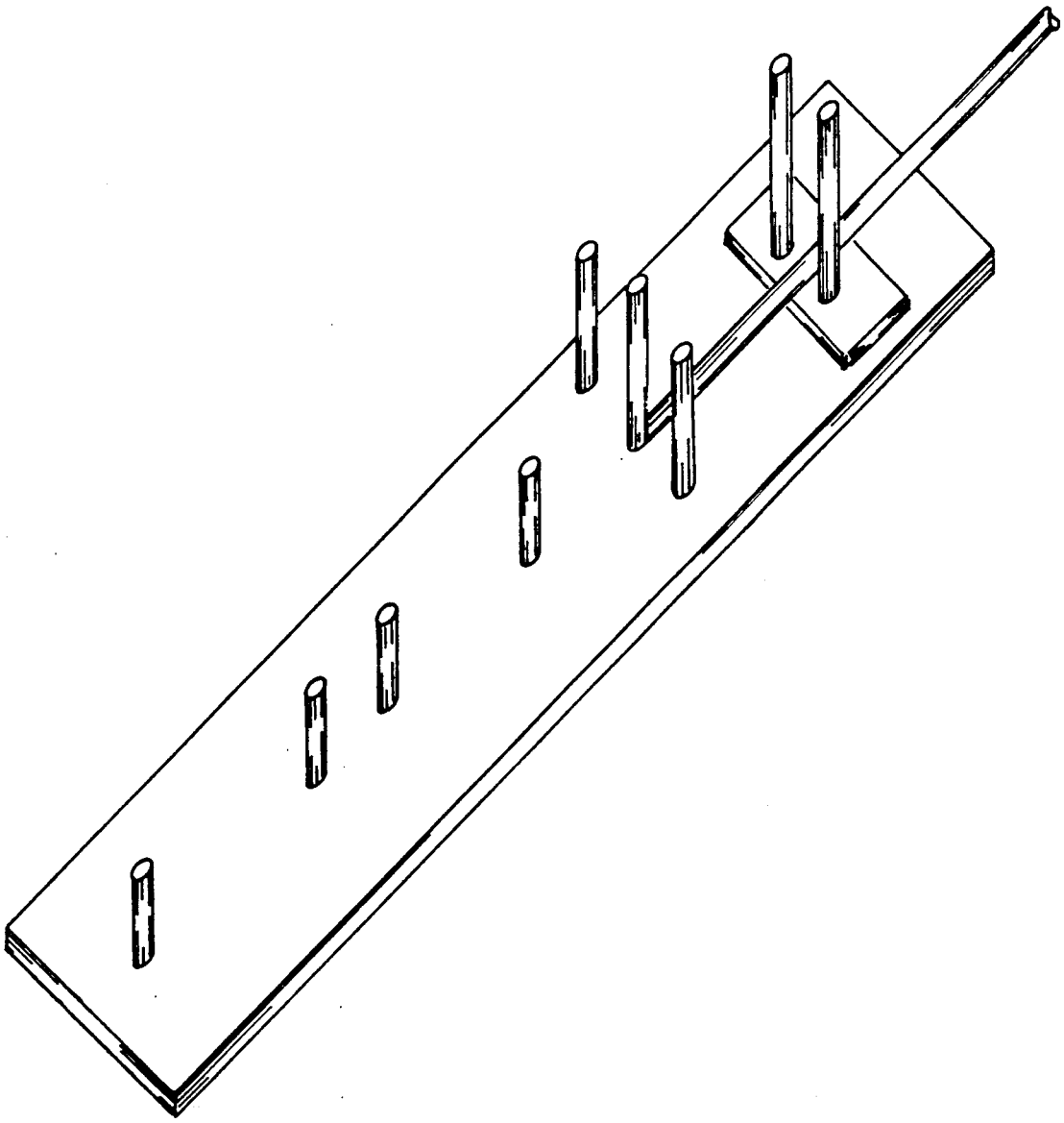
FIG. 3 is a representation of the actual physical embodiment of the antenna shown schematically in FIG. 2, the embodiment having been optimized and tested for the frequency range between 1500 megahertz and 2000 megahertz.

As in the embodiment of FIG. 1, all the elements shown schematically in FIG. 2 can be supported upon a sheet of dielectric material such as fiberglass-reinforced epoxy resin. An assembly including all the electroconductive elements supported suitably on such a sheet of fiberglass-reinforced plastic is shown in FIG. 3 of the drawings. In that figure, the source of energy which would be connected to the coaxial transmission line is not shown.

As is evident from FIG. 3, the spacing between the director elements is not uniform. Likewise, the lengths of the dipole element and of the conductive elements on either side thereof are different. Still further, the lengths of the reflector elements differ from those of the dipole element and of the conductive elements on either side thereof. Finally, FIG. 3 shows graphically that the reflectors and dipole element in the structure are formed of hollow tubing. Actually, it is functionally insignificant whether these conductive elements are hollow or solid because there can be no electromagnetic fields within them. For reasons of workability, we prefer to employ copper tubing for the reflector and dipole elements of our antenna. Inasmuch as the directors are to have smaller outside diameters, we prefer to form them from solid rod stock about one millimeter in diameter.

The scale in FIG. 3 shows that the overall length of the antenna illustrated therein is only about ten and one-half inches. The antenna is also constructed of very light and easily available materials. Accordingly, it is inexpensive to manufacture, and is sufficiently compact that it can be used in applications, such as military communications, where space may be very important. By contrast, a so-called "log periodic" antenna of comparable directivity would have to be about thirteen inches long in order to equal the broad-band characteristics of our antenna.

Figure 6:
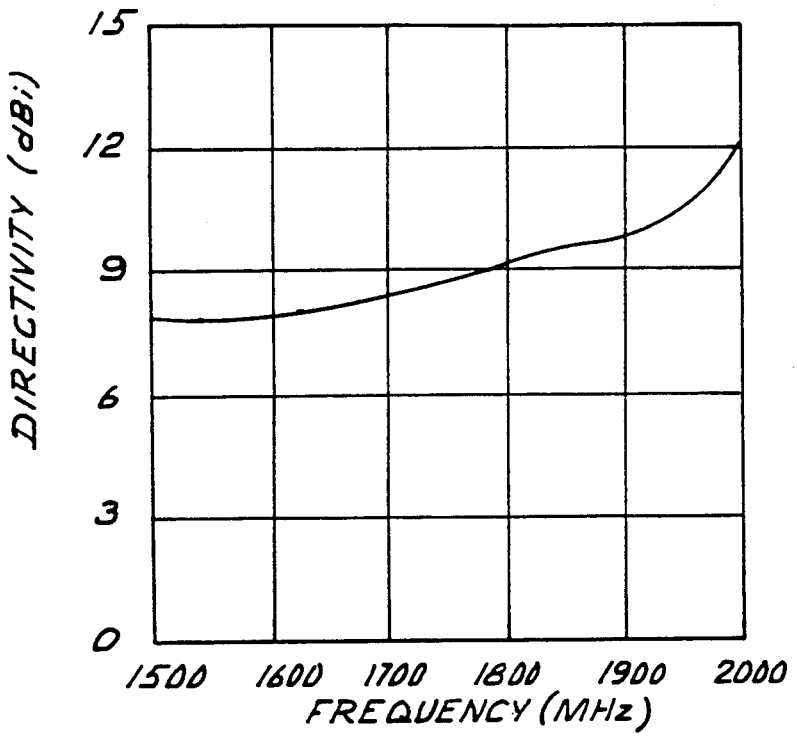
FIG. 6 is a plot of directivity or gain of an antenna in accordance with our invention throughout the frequency range between 1500 megahertz and 2000 megahertz.

The antenna illustrated in FIG. 3 has been optimized for the band between 1500 megahertz and 2000 megahertz. Therefore, the geometric mean frequency of that band was 1732 megahertz. For that mean frequency, the effective bandwidth of the antenna extends $16\frac{2}{3}$ percent below the mean frequency and $16\frac{2}{3}$ percent above the mean frequency, making a total bandwidth of $33\frac{1}{3}$ percent. As shown in FIG. 6 of the drawings, the directivity, or gain, of this optimized antenna begins at 7.8 dBi at 1500 megahertz and ranges upwardly to 12 dBi at 2000 megahertz, with no points of lower directivity within that band of frequencies. Expressing the performance in a different way, the directivity or gain of the antenna is 9.9 dBi±2.1 dBi over the entire bandwidth of 33⅓ percent.

Figure 7:
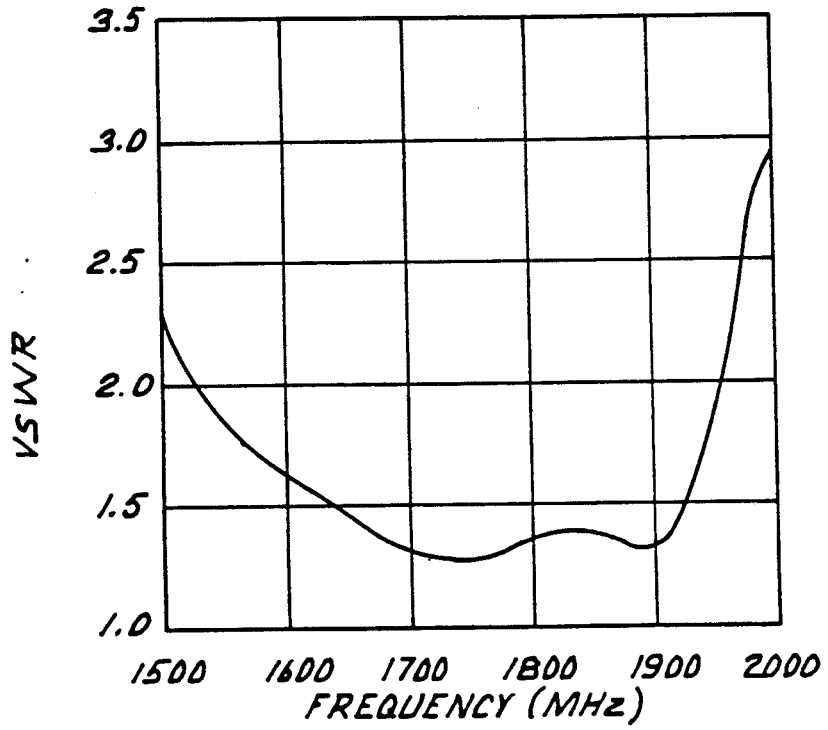
FIG. 7 is a plot of voltage-standing-wave ratio (VSWR) as a function of frequency for our antenna throughout the range between 1500 megahertz and 2000 megahertz.

Turning to FIG. 7 of the drawings, we observe that the optimized antenna of FIG. 3 is characterized by a voltage-standing-wave ratio of less than 3.0 to 1 over the entire bandwidth of 33⅓ percent. Still further, the antenna is characterized by a voltage-standing-wave ratio of less than 2.0 to 1 over a bandwidth of twenty-five percent, between about 1535 megahertz and 1960 megahertz.

The placement and dimensions of the conductive elements in the antenna of FIGS. 2 and 3 are set forth in the Table below. In the Table, each conductive element is assigned an element number which is the same as the reference number assigned to that element in FIG. 2 of the drawings. The X position and Y position of each element are given in accordance with the coordinate system described in the explanation of FIG. 2. The length and radius of each element are also set forth in that order in the Table below. The length and radius of each conductive element are given in centimeters

| ELEMENT NO. | X - POSITION | Y - POSITION | LENGTH | RADIUS |
|---|---|---|---|---|
| 41 | −0.4 | 4.4 | 8.6 | 0.17907 |
| 42 | +0.4 | 4.4 | 8.6 | 0.17907 |
| 43 | −2.0 | 0 | 5.92 | 0.17907 |
| 44 | 0 | 0 | 8.0 | 0.17907 |
| 45 | +2.0 | 0 | 5.92 | 0.17907 |
| 46 | 0 | −4.206 | 6.346 | 0.06350 |
| 47 | 0 | −10.115 | 6.258 | 0.06350 |
| 48 | 0 | −14.815 | 6.316 | 0.06350 |
| 49 | 0 | −20.957 | 6.258 | 0.06350 |

Reference to the Table above shows that the length of the dipole element is slightly less than that of each of the reflectors but greater than that of the conductive elements on either side of the dipole element. The directors decrease slightly in length in the direction away from the dipole element. However, the decrease in length is not linear or uniform. The radius of the dipole element is the same as that of the reflectors and the conductive elements on either side of the dipole element, and is more than twice the radius of the directors, all of which are of the same radius.

Reference to the Y distances of the directors shows that they are not equally spaced, the distance between the two directors most remote from the dipole element being the greatest of the spacings between respective adjacent pairs of directors. The lengths and spacings of all the aforementioned elements have been determined by a "perturbation process" involving convergent solutions of simultaneous integral equations by means of a digital computer. Although these lengths and spacings are regarded as optimum for the band between 1500 and 2000 megahertz, they should not be regarded as critical in the definition of our invention.

The dimensions given in the Table have been optimized for a frequency range in what is commonly known as "L-band". If the antenna were to be re-scaled for operation over a thirty-three percent range in a somewhat higher frequency range, such as "S-band", certain adjustments of the lengths and spacings of the conductive elements would have to be made. However, the general principles of our invention, which result in maximizing the useful bandwidth consistent with optimized directivity, would still apply.

In order to generalize the principles of our invention, a table of dimensions and spacings of the conductive elements of the antenna in terms of wavelength is presented below. It will be understood that the wavelength for each entry in the table is the wavelength of the geometric mean frequency of the band of frequencies which is to be covered by the antenna. That is to say, "Lambda" in the table corresponds to the geometric mean frequency of the useful band of the antenna, according to the relationship $$\frac{F_L}{F_{GM}} = \frac{F_{GM}}{F_H}.$$

| ELEMENT NO. | X-POSITION | Y-POSITION | LENGTH | RADIUS |
|---|---|---|---|---|
| 41 | −0.02311λ | 0.25420λ | 0.49685λ | 0.01035λ |
| 42 | 0.02311λ | 0.25420λ | 0.49685λ | 0.01035λ |
| 43 | −0.11555λ | 0.00000λ | 0.34202λ | 0.01035λ |
| 44 | 0.00000λ | 0.00000λ | 0.46219λ | 0.01035λ |
| 45 | 0.11555λ | 0.00000λ | 0.34202λ | 0.01035λ |
| 46 | 0.00000λ | −0.24300λ | 0.36663λ | 0.03669λ |
| 47 | 0.00000λ | −0.58438λ | 0.36155λ | 0.03669λ |
| 48 | 0.00000λ | −0.85592λ | 0.36490λ | 0.03669λ |
| 49 | 0.00000λ | −1.21076λ | 0.36155λ | 0.03669λ |

Figure 4:
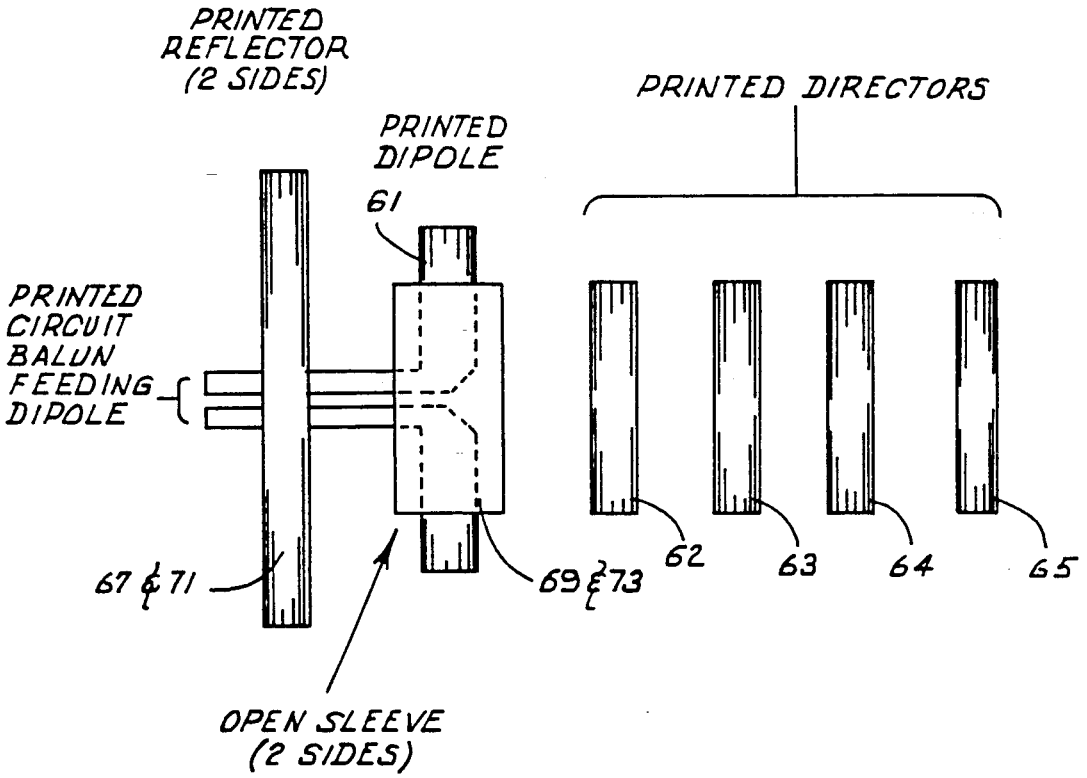
FIG. 4 is a schematic representation of an antenna in accordance with our invention in which the dipole element and the parasitic elements associated with it are printed on dielectric material as might be done with stripline construction. It is noteworthy that all the elements have a substantial dimension in the direction of passage of energy through the antenna.

Turning now to FIG. 4 of the drawings, we find a schematic representation of an antenna formed by means of stripline techniques in which the conductive components, instead of being essentially filamentary in nature, are formed from flat conductive material having an appreciable breadth or dimension in the direction of passage of electromagnetic energy through the antenna. In the most general case, the antenna would require four layers of dielectric material in order to support the layers of conductive material which may be applied thereto by etching or by printing processes. In the configuration of FIG. 4, a dipole 61 is printed on one surface of a first layer of dielectric material 60. Directors 62 through 65 are printed on the same surface of dielectric material 60. A second layer of dielectric material 66 is then positioned over the printed conductive components. A reflector 67 may then be printed on the opposite surface of second layer of dielectric material 66. A third layer of dielectric material 68 is then positioned over the surface of printed reflector 67. On the remote surface of third dielectric layer 68 may be printed a conductive element 69, which constitutes one side of the "open-sleeve" structure.

On the opposite side of first layer of dielectric material 60 from the side on which dipole 61 and directors 62 through 65 are printed may be printed a reflector 71 corresponding to and symmetrical with reflector 67. A fourth layer of dielectric material 72 is then positioned over the surface of printed reflector 71. A conductive element 73 may then be printed on the remote side of fourth layer of dielectric material 72, such conductive element 73 then becoming the complementary element to conductive element 69, separated therefrom by the four layers of dielectric material. The aforementioned sequence of assembly assumes that it is desired to have the conductive elements flanking the dipole element spaced more widely from the dipole element than the reflector elements are spaced from the transmission line, which is aligned with the dipole element on the surface of first layer of dielectric material 60.

Figure 5:
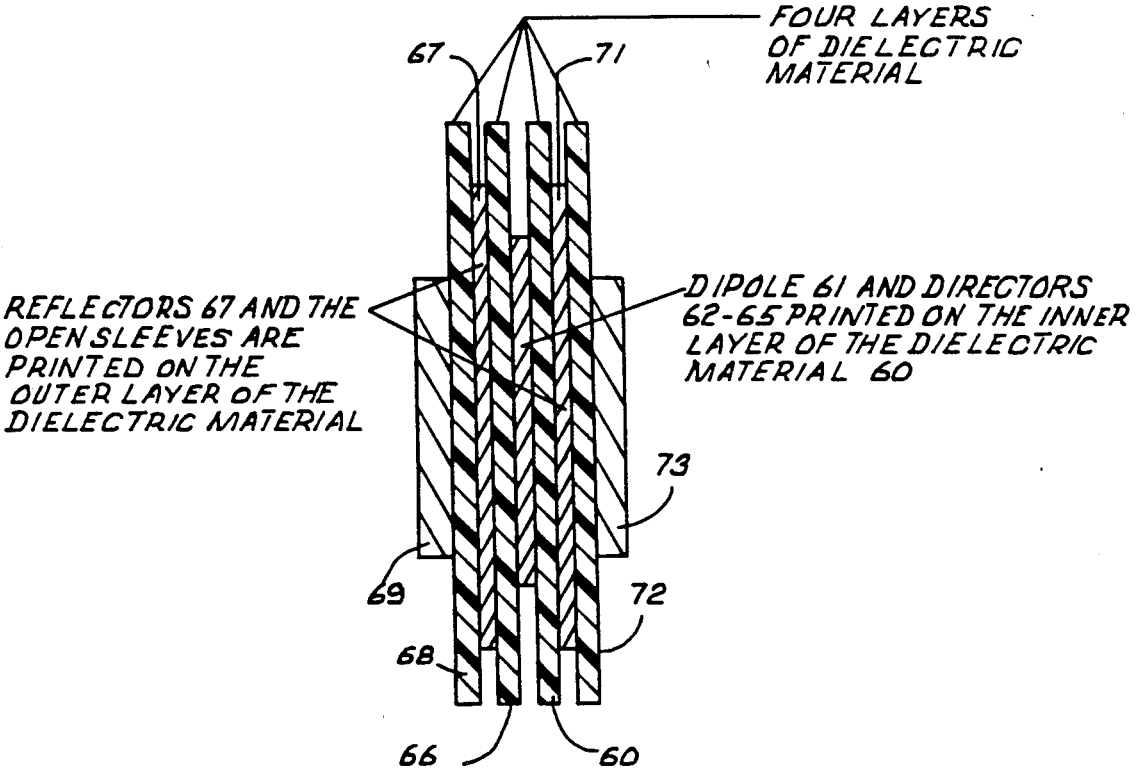
FIG. 5 is a schematic representation of a way in which the parasitic elements may be constructed using printed-circuit techniques as aforementioned.

If it should happen that the desired lateral spacing for the reflectors and for the conductive elements flanking the dipole element is the same, then the construction shown schematically in FIG. 5 of the drawings can be employed. In that construction, only three layers of dielectric material are necessary for spacing purposes, but a fourth may be used, serving only to protect the conductive elements. Thus if an antenna is "laminated" by printed-circuit techniques, all the conductive elements can be protected from damage within the "sandwich" of dielectric material.

Just as the nature of the structure can be changed from filamentary to stripline, so too can the filamentary structure be transposed from one frequency range to another to accommodate other bands besides L-band. As illustrated in the second Table above, it has now become possible to realize an antenna having high directivity and low voltage-standing-wave ratio over a relatively wide band of contiguous frequencies as contrasted with prior-art antennas such as Yagi-Uda antennas. In any case, the antenna according to our invention should comprise at least one reflector element, one dipole element, a closed sleeve or two conductive "open sleeve elements", and a plurality of director elements. The director elements should preferably be spaced non-uniformly and have slightly unequal lengths.

The length of the reflector and the spacing thereof should be optimized for operation near the low-frequency cut-off frequency of the antenna. Thus, the reflector must be designed to have an inductive reactance over the entire bandwidth of the antenna. On the other hand, the directors must be optimized for operation near the high-frequency cut-off of the antenna. They must have a capacitive reactance over the entire bandwidth of the antenna. If the antenna is to function according to our invention, the reflector must be inductive at all operating frequencies, while the directors must be capacitive at all operating frequencies.

The foregoing specification has described three principal ways in which our invention can be practiced. Of course, certain modifications may be made without departing from the scope of the invention. Accordingly, the invention is defined by the following claims.

We claim:

1. An antenna for transmitting or receiving electromagnetic energy throughout a band of frequencies, said antenna comprising:

(a) a dipole element for orientation substantially in the direction of the electric vector of said transmitted or received electromagnetic energy, (b) transmission line means for connecting said dipole element to a source or receiver of electromagnetic energy, at least a portion of said transmission-line means adjacent to said dipole element being disposed substantially normal to said dipole element and substantially parallel to the general direction of passage of energy through said antenna, (c) at least one parasitic structure disposed substantially parallel to said dipole element so that two conductive portions of said structure are in a plane passing through said dipole element normal to said transmission-line means and to the general direction of energy through said antenna, said two conductive portions being on opposite sides of said dipole element and having lengths equal to at least half the length of said dipole element, (d) first and second conductive reflector elements disposed symmetrically with and substantially parallel to said dipole element and within one-quarter wavelength at the mean frequency of said band of frequencies of said transmission-line means, and (e) a plurality of conductive director elements respectively disposed substantially parallel to said dipole element in spaced relationship in a line away from said dipole element in a direction substantially opposite to the direction of said transmission line means from said dipole element.

2. An antenna in accordance with claim 1, further including resonant-circuit means in said transmission-line means for substantially matching the impedance of said antenna to that of said source or receiver.

3. An antenna in accordance with claim 1 in which said parasitic structure disposed substantially parallel to said dipole element is in the form of a cylinder of which said two conductive portions are generatrices.

4. An antenna in accordance with claim 1 in which said parasitic structure disposed substantially parallel to said dipole element comprises a pair of linear elements on opposite sides of said dipole element in said plane passing through said dipole element normal to said transmission-line means.

5. An antenna in accordance with claim 1 in which the dimensions of said parasitic structure and of respective ones of said reflector and director elements are selected so that the operating frequency band extends approximately sixteen percent below and sixteen percent above the center point of said band of frequencies.

6. An antenna in accordance with claim 1, further including a substantially planar dielectric member for supporting said parasitic structure and said reflector and director elements at or near their respective midpoints.

7. An antenna in accordance with claim 1, having three conductive director elements.

8. An antenna in accordance with claim 1, having four conductive director elements.

9. An antenna in accordance with claim 1, further including at least one substantially planar dielectric member disposed in the direction of the electric vector of said transmitted or received electromagnetic energy and extending in the general direction of passage of energy through said antenna, said substantially planar dielectric member supporting said dipole element.

10. An antenna in accordance with claim 1, further including at least one substantially planar dielectric member disposed in the direction of the electric vector of said transmitted or received electromagnetic energy and extending in the general direction of passage of energy through said antenna, said substantially planar dielectric member supporting at least one of said parasitic conductive portions of said structure.

11. An antenna in accordance with claim 1, further including at least one substantially planar dielectric member disposed in the direction of the electric vector of said transmitted or received electromagnetic energy and extending in the general direction of passage of energy through said antenna, said substantially planar dielectric member supporting at least one conductive reflector element.

12. An antenna in accordance with claim 1, further including at least one substantially planar dielectric member disposed in the direction of the electric vector of said transmitted or received electromagnetic energy and extending in the general direction of passage of energy through said antenna, said substantially planar dielectric member supporting at least one of said plurality of conductive director elements.

13. An antenna in accordance with claim 9 in which said dipole element comprises conductive material applied to the surface of said substantially planar dielectric member.

14. An antenna in accordance with claim 10 in which said conductive portions of said parasitic structure comprise conductive material applied to the surface of said substantially planar dielectric member.

15. An antenna in accordance with claim 10 in which said conductive portions of said parasitic structure are stripline having a substantial dimensional component in the direction of passage of energy through said antenna.

16. An antenna in accordance with claim 11 in which at least one of said conductive reflector elements comprises conductive material applied to the surface of said substantially planar dielectric member.

17. An antenna in accordance with claim 12 in which said plurality of conductive director elements comprise conductive material applied to the surface of said substantially planar dielectric member.

18. An antenna in accordance with claim 9 in which there are two substantially planar dielectric members.

19. An antenna in accordance with claim 18 in which the dipole element and one conductive portion of said parasitic structure are supported by one dielectric member, while the other conductive portion of said parasitic structure is supported by the other dielectric member.

20. An antenna in accordance with claim 2 in which said resonant circuit means comprise a balun.

* * * * *